United States Patent [19]

Weese

[11] Patent Number: 4,763,581

[45] Date of Patent: Aug. 16, 1988

[54] MULTI-STATION CARREL UNIT

[75] Inventor: Benjamin H. Weese, Chicago, Ill.

[73] Assignee: Midland Manufacturing Corp., Skokie, Ill.

[21] Appl. No.: 941,638

[22] Filed: Dec. 15, 1986

[51] Int. Cl.[4] ..... A47B 57/00

[52] U.S. Cl. ..... 108/92; 108/60; 312/196

[58] Field of Search ..... 108/92, 91, 60, 64, 108/33, 38; 312/196, 198, 203, 107, 235 R; 297/147, 158, 174; D6/421

[56] References Cited

U.S. PATENT DOCUMENTS

| | | | |
|---|---|---|---|
| D. 153,373 | 4/1949 | Metro . | |
| D. 161,772 | 1/1951 | MacDonald . | |
| D. 179,454 | 12/1956 | Knobloch . | |
| D. 208,413 | 8/1967 | Ball . | |
| D. 220,111 | 3/1971 | Gianfagna . | |
| D. 225,796 | 1/1973 | Helverson . | |
| D. 242,190 | 11/1976 | White et al. . | |
| 949,196 | 2/1910 | McIntosh | 108/92 |
| 1,429,939 | 9/1922 | Eichman | 297/158 |
| 2,375,726 | 5/1945 | Bales | 108/64 X |
| 2,527,944 | 10/1950 | Linder . | |
| 2,673,132 | 3/1954 | Alderman . | |
| 2,696,418 | 12/1954 | Bombarr | 312/282 X |
| 2,908,400 | 10/1959 | Richter | 108/60 |
| 3,010,774 | 11/1961 | Doherty . | |
| 3,160,451 | 12/1964 | Lewis | 312/196 |
| 3,338,648 | 8/1967 | Bannister | 312/196 X |
| 3,361,090 | 1/1968 | Howlett . | |
| 3,389,947 | 6/1968 | Kelley et al. | 108/60 X |
| 3,858,528 | 1/1975 | Peterson | 108/60 |
| 4,102,275 | 7/1978 | Spound et al. | 108/92 |
| 4,178,047 | 12/1979 | Welch | 108/60 X |
| 4,217,832 | 8/1980 | Pozzan | 108/64 X |
| 4,378,727 | 4/1983 | Doss | 108/60 X |
| 4,484,787 | 11/1984 | Stephens | 108/60 X |

FOREIGN PATENT DOCUMENTS 1525299 5/1968 France .

OTHER PUBLICATIONS

*College & Research Libraries News*, "Grinnell College—America's Comfiest Academic Library?", Nov. 1984; vol. 45, No. 10.

Architectural Brochure Used As Introduction to Burling Library, Grinnell College (Reprinted from *Architectural Record*, Mar. 1985).

*Primary Examiner*—Peter A. Aschenbrenner
*Assistant Examiner*—Jose V. Chen
*Attorney, Agent, or Firm*—Linda A. Kuczma; Ralph R. Rath

[57] ABSTRACT

A multi-tiered, multi-station carrel unit includes spaced side walls that define a plurality of compartments divided into work stations by a intermediate deck, each work station having a work-supporting surface and a seat defined therein. A stairwell leads to the upper work stations and the carrel units may be assembled in any desired pattern.

7 Claims, 3 Drawing Sheets

MULTI-STATION CARREL UNIT

DESCRIPTION

Technical Field

The present invention relates generally to cubicle constructions for use in confined spaces, such as multiple-purpose rooms, and, more particularly, to a multi-station multiple tiered work area.

BACKGROUND OF THE INVENTION

Presently available furniture that is specifically designed for use in large public areas, such as libraries, is generally designed to allow for some privacy for the occupants when a number of such occupants are located in a very confined space. The most common type of furniture used in public areas such as libraries where privacy is required, includes a plurality of partitions that are interconnected to define a plurality of individual cubicles that generally have a height in the range of about four to five feet and are open at the top and at least one side. generally, such furniture arrangement includes a small desk or table and a chair located within each of the cubicles to define a seating area and a work surface for the occupant.

In most instances, these types of partition structures are easily dismantled by removal of screws or other fasteners and the partitions or panels can then be disassembled and reassembled to a different configuration to suit the needs of the particular space involved. However, such units do not provide the desired amount of privacy.

In order to maximize the use of the floor space, it has been proposed to utilize nestible carrels wherein each carrel is constructed of a generally triangular configuration and the carrels can then be arranged into a rectangular structure, thereby providing four work stations in a very confined space. An example of such structure is disclosed in U.S. Pat. No. 3,858,528. While such an arrangement effectively provides a maximum seating capacity and work area in a small confined space, the cost thereof is rather high since each of the units must be completely self-supporting so that there is practical utility for each individual unit.

In order to maximize the utilization of floor space in public areas, such as libraries, it has also been proposed to provide a multi-tiered arrangement wherein at least two work stations are positioned above each other so that the seating capacity and work space can be doubled for any given floor space.

However, as far as is currently known, such multi-tiered structures have been designed to be custom made to occupy a predetermined space with the construction and configuration being particularly adapted for a given floor space.

Thus, there remains a need for a versatile furniture construction that allows for substantially complete privacy in a confined area, maximizes the utilization of the floor space and has great versatility in construction and assembly.

SUMMARY OF THE INVENTION

According to the present invention, a multi-station carrel unit has been developed that maximizes the utilization of floor space and provides substantially total enclosed work stations and wherein the work stations are tiered above each other. The carrel unit is designed such that a plurality of multiple station units can easily be assembled in a very confined space with easy access to the upper stations from the floor through a common area.

More specifically, the carrel unit constructed in accordance with the present invention consists of a plurality of horizontally-spaced, vertically-extending, subtantially coextensive side walls that have front, rear, top and bottom edges defining spaced compartments with a deck means extending between adjacent side walls to divide each of the compartments into at least an upper and a lower work station. The deck means define the floor for the upper work station and the ceiling for the lower work station.

A work-supporting surface is located in the lower station of each compartment and is supported on the side walls adjacent the rear edges, while a second work-supporting surface is located in the upper station of each compartment and is supported on the side walls adjacent the front edges to be offset from the first work-supporting surface, in the front-to-rear direction. A first seating means is located in the lower station and is positioned between the front edges of the side walls and the first work-supporting surface, while a second seating means is located in the upper station between the rear edges of the side walls and the second work-supporting surface so that the weight of the occupants is generally balanced in the work stations of each vertical compartment.

The carrel unit also incorporates access means in the form of a ladder that extends from the floor to the deck means.

In one specific embodiment of the invention, the carrel unit is designed to have four work stations of substantially equal size defined in one unit which has a back wall designed to be positioned against a wall of a room. In this embodiment, the carrel unit includes four substantially coextensive side walls that extend vertically and are spaced from each other with the access means being in the form of a ladder mounted between the two adjacent intermediate side walls of the carrel unit. Each pair of adjacent side walls has a generally horizontal deck that is spaced from the upper and lower edges and defines the floor for an upper work station in one compartment and a ceiling for the second work station located in the lower portion of the compartment. The first and second work-supporting surfaces are laterally offset from each other and each work station has a seat means located therein which is generally vertically-aligned with the work-supporting surface in the next teired unit. Thus, the loads that are supported in the unit during use are balanced so that each unit is completely self-supporting and substantially portable in nature.

In this specific embodiment illustrated, the carrel consists of a self-supporting four-station multiple compartment unit that is defined by four substantially-identical vertical side walls. Two intermediate side walls that cooperate with the outside walls to define two compartments. The intermediate walls are spaced a small distance to define a stairwell which has stairs leading from the lower edge to a deck that defines the floor for the upper work stations. The spacing between the intermediate walls can be varied to fit into a small, confined space.

The two compartments on opposite sides of the stairwell are divided by the deck into upper and lower work stations of substantially identical size and configuration. Each lower work station has a work-supporting surface located between the ceiling and the lower edges, being supported on the side walls adjacent the rear edges. A bench-type seat is preferably positioned adjacent the forward edge, and is also supported on the side walls while being located totally within the confines of the side walls.

The upper work station is substantially identical in construction and is reversed so that the upper seat is located above the lower work-supporting surface and the upper work-supporting surface is located above the lower seat means to provide a symmetry in construction for each compartment.

In this embodiment, the unit preferably has a rear wall for enclosing at least a portion of the area between the two adjacent side walls that define the respective compartments and partitions or panels may extend from the upper work-supporting surface to the dividing deck to provide privacy in the area below the work-supporting surface of the upper work station.

In a slightly modified form of the invention, the self-supporting carrel unit is designed to define eight work stations in one self-supporting unit, which again can be assembled with additional units to provide an almost-endless array of cubicle structures for a very confined space. In this construction, the units may be arranged so that the access means or stairs provide a common access to the upper deck for all of the upper work stations in the assembly.

More specifically, in the modified form of the invention, the carrel unit includes three substantially coextensive vertical side walls that are equally spaced from each other to define first and second compartments. Each compartment is divided into upper and lower sections by a generally horizontal deck which has a common wall extending from the lower surface thereof to the lower edge of the respective side walls to divide the lower section into first and second lower work stations that each have a work-supporting surface located adjacent the common wall and a seating area located below the work-supporting surface but supported within the confines of the side walls.

Each of the upper sections of each compartment has a common walkway located above the lower dividing wall to produce a front work station and a rear work station which have a common walkway located above the lower dividing wall. The walkway extends from one end of the unit to the opposite end. Each upper work station again has a work-supporting surface, the two work-supporting surfaces being located respectively adjacent the front and rear edges of the side walls and being supported on the two adjacent side walls, while the two seat means are located adjacent the walkway defined generally along the center of the unit.

The seating arrangement can easily be varied and could be in the form of a conventional chair, a bench seat that is generally rectangular and supported at opposite ends on the two adjacent side walls, or a pedestal-type bench that is supported on one of the side walls at one end and a leg on the opposite end so that access can be gained without stepping over the bench.

BRIEF DESCRIPTION OF SEVERAL VIEWS OF DRAWINGS

DETAILED DESCRIPTION

Figure 1:
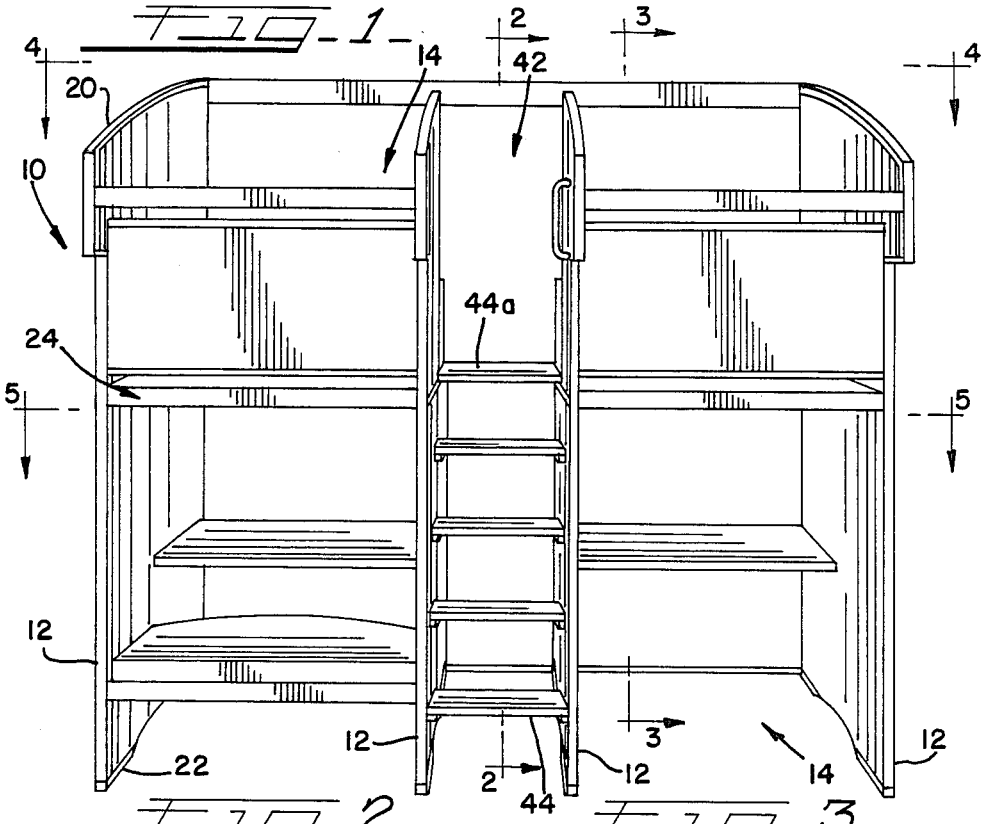
FIG. 1 is a perspective view of a preferred form of the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

FIG. 1 of the drawings shows a multistation carrel unit, generally designated by reference numeral 10, that is preferably totally self-supporting and is generally portable in nature. The carrel unit consists of a plurality of substantially identical side walls 12 that extend vertically and are transversely spaced from each other to define first and second vertically-extending compartments 14, there being two such compartments illustrated in the preferred embodiment. Two adjacent pairs of side walls 12 define the opposite ends of each of the compartments 14 and have front and rear edges 16 and 18, a top edge 20, and a bottom edge 22, which defines a substantially coplanar supporting surface, as will become apparent later. The bottom edge may be recessed or cut out, as at 23, to produce corner legs or supports 25. Also, the upper edge may be aesthetically configured as desired.

A deck means 24 divides each of the compartments 14 into a lower work station and upper work station, which are substantially identical in configuration and construction. The deck means 24 defines a ceiling for the lower work station and a floor for the upper work station.

Figure 3:
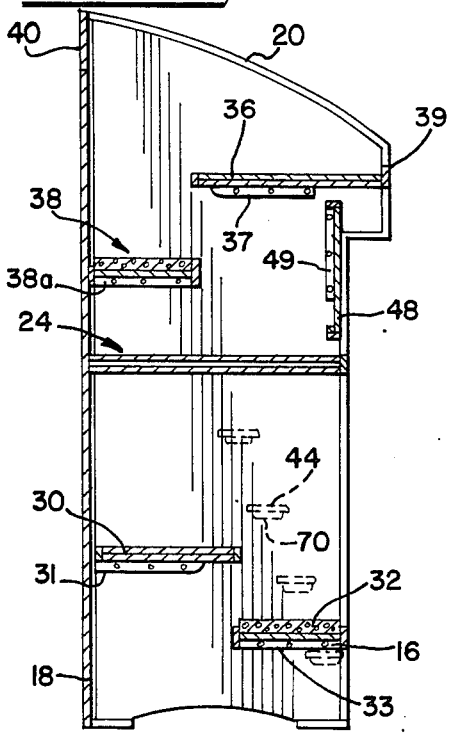
FIG. 3 is a cross sectional view as viewed along line 3—3 FIG. 1.

Thus, as shown in FIGS. 1 and 3, the lower work station includes a work-supporting surface 30 that extends generally horizontally between adjacent sides walls 12 and is supported by brackets 31 secured to the side walls. As illustrated in the drawings, the lower work-supporting surface 30 has a rear edge that is substantially vertically aligned with the rear edges 18 of the spaced side walls 12 while the front edge of the work-supporting surface is spaced a substantial distance from the front edges 16 of the side walls. A seat means 32 is supported on the side walls by brackets 33 and is located adjacent the front edges 16 and extends rearwardly below the work-supporting surface 30, the edges being illustrated as vertically aligned.

Likewise, the upper work station has an upper work-supporting surface 36 which has a front edge that is generally aligned with the front edges 16 of the side walls 12 and has a rear edge which terminates forwardly of the rear edges of the side walls 12. The work-supporting surface 36 may be supported by brackets 37. A seat means or bench 38 substantially similar to the seat means 32 extends between and is supported by brackets 38*a* on the side walls 12 adjacent the rear edges 18 and again is positioned below the upper work-supporting surface. The front portion of side walls 12 may have a forward projection 39 to increase the work area on the upper work surface 36, as shown.

A rear wall 40, which preferably extends from the upper edge to the lower edge, between the two outside side walls 12 completes the external construction of the unit.

In the embodiment illustrated, the two intermediate side walls 12 define a stairwell 42 which has a plurality of steps 44 that extend between and are supported on the two intermediate side walls. Preferably the upper stair 44*a* is aligned with the deck means in the two adjacent compartments 14 and an access opening 46 is defined in the intermediate side walls 12 for gaining access into the respective upper work stations from the stairwell. In addition, the forward space between the upper work-supporting surface 36 and the intermediate deck 24, which defines the ceiling for the lower work station and the floor for the upper work station has a privacy panel 48 extending between the side walls 12 and supported by brackets 49 to enclose the area below the work-supporting surface and the floor.

Figure 6:
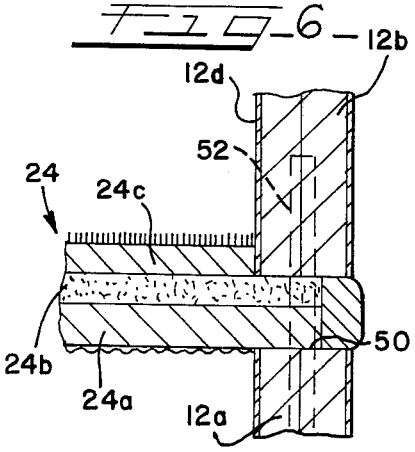
FIG. 6 is a fragmentary cross-sectional view as viewed along line 6—6 of FIG. 2.

While the specific construction details of the unit can vary to a significant degree, a preferred embodiment of construction will be described with respect to the majority of the components. Thus, as shown in FIG. 6, the deck means is preferably in the form of a plurality of respective layers to provide the necessary rigidity and load support for the occupants on the second level of the unit. Thus, the deck means 24 includes a lower deck floor joist 24(*a*) that extends through the side wall 12 which is shown in this embodiment as including a lower side wall portion 12(*a*) and an upper side wall portion 12(*b*) having an opening 50 therein. The lower floor joist or member 24(*a*) extends into the opening 50 and is supported on the upper edge of the lower side wall portion 12(*a*). Likewise, a second floor panel 24(*b*) is substantially coextensive with the first floor panel 24(*a*) and has an end portion received into the opening 50 to be supported on the lower side wall portion 12(*a*) that thus defines a load bearing wall for the assembled structure. A further layer 24(*c*) preferably an acoustical or carpeting layer is then installed on top of the floor panel 24(*b*). A dowel pin 52 extends into openings in the panel portions 12(*a*) and 12(*b*) to hold the unit in the assembled condition.

The lower floor joist 24(*a*) may be a plywood panel of suitable thickness while the second floor panel 24(*b*) may be a particle board. The side walls 12(*a*),(*b*) could be formed of particle board and covered with a plastic laminate 12(*d*), as shown in FIG. 6.

The work-supporting surfaces 30, 36 are supported on the side walls 12 in a manner that the entire unit can be shipped in an unassembled condition and can easily be assembled without any special skills or tools. Thus, each side wall 12 has supporting blocks or brackets 31, 37 that are secured by screws (not shown) to each of the side walls. The brackets 31, 37 are horizontally aligned with the each other on the adjacent side walls and thus the work-supporting surface can be slid in and supported on the upper surfaces of the brackets 31, 37 and can be secured in position by suitable screws (not shown). Similar brackets 33, 38(*a*) can also be utilized for supporting the bench seats described above as well as the stairs in the stairwell.

Figure 5:
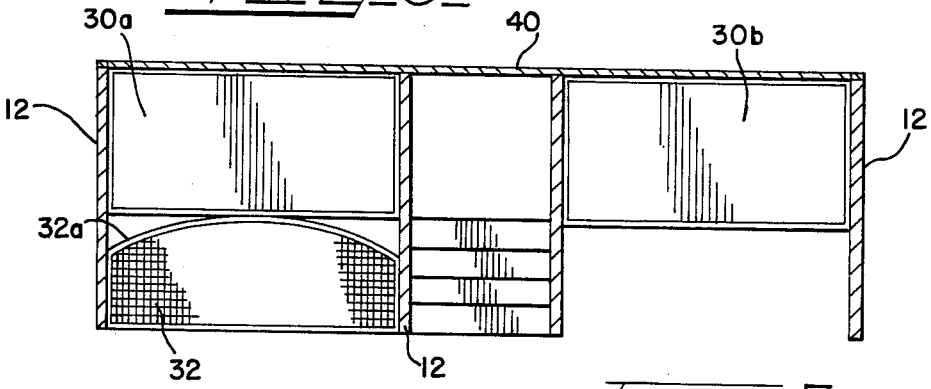
FIG. 5 is a sectional view as viewed along line 5—5 of FIG. 1 showing the lower work stations.

The work-supporting surfaces 30, 36 and the seats 32, 38 can be formed of any configuration. Thus, as illustrated in FIG. 5, the lower work-supporting surface could be rectilinear, as shown at 30(*a*) while the seat could be a bench seat 32 having an arcuate edge 32(*a*) and extend between side walls 12. Alternatively, the work-supporting surface could be L-shaped as shown at 30(*b*) in FIG. 5. This configuration is particularly adapted as a computer station providing surface area for a keyboard and a separate screen along with a typewriter and work space. In this configuration, a conventional chair (not shcwn) could be used as the seat means.

Figure 4:
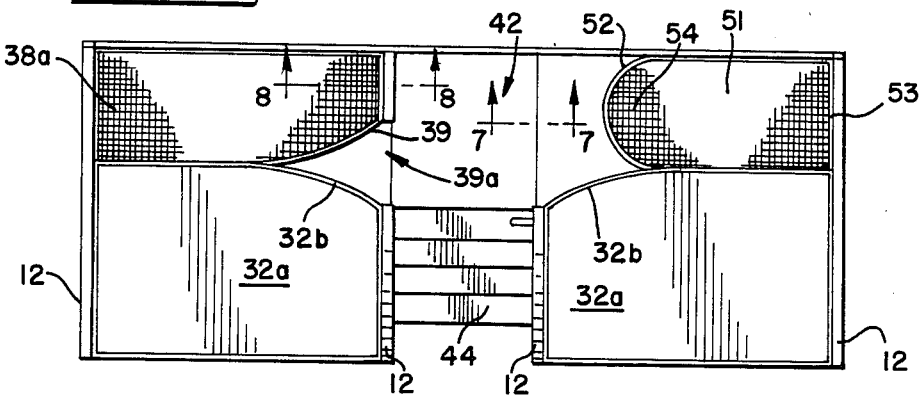
FIG. 4 is a top plan view of the carrel as viewed along 4—4 of FIG. 1.

Alternatively, the work-supporting surface and seat could take the form illustrated in FIG. 4. The upper seat 38(*a*) could be a bench seat having an arcuate edge 39 adjacent the stairwell 42 while the work-supporting surface 32(*a*) could have an arcuate inner edge 32(*b*) to provide an access space 39*a*. As a further alternative, the seat could be a pedestal seat 51 having an arcuate inner edge 52 spaced from side wall 12 and a planar edge 53 supported on outer side wall 12. A leg 54 could support the inner end of seat 51.

Figure 8:
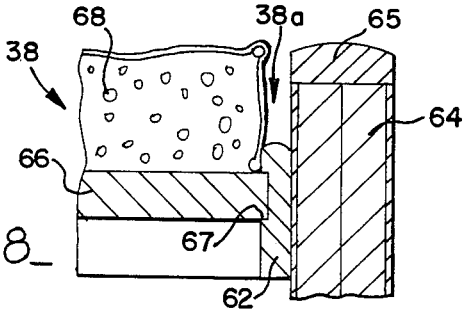
FIG. 8 is a fragmentary cross-sectional view as viewed along line 8—8 of FIG. 4.

The seat support 38(*a*) for the bench seat 38 is illustrated in FIG. 8 and includes a bracket 62 supported on an extension 64 of side wall 12. The extension may have a suitable decorative cap 65. The bench seat includes a base 66 extending into a recess 67 on bracket 62 and supports a cushion 68.

Figure 2:
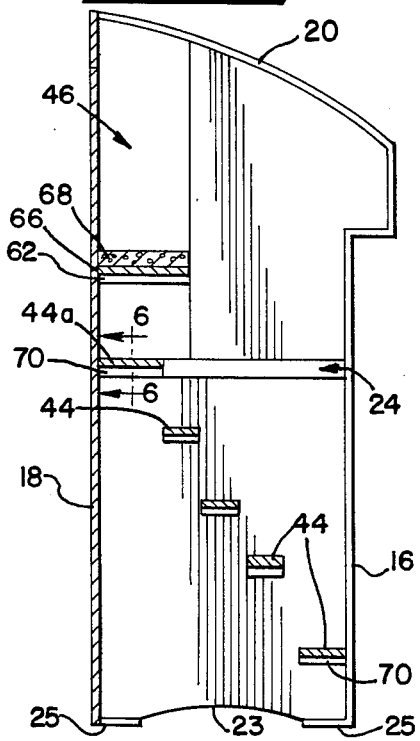
FIG. 2 is a cross sectional view as viewed along line 2—2 of FIG. 1.
Figure 7:
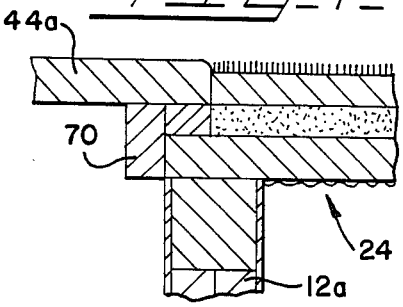
FIG. 7 is a fragmentary cross-sectional view as viewed along line 7—7 of FIG. 4.

FIG. 2 and 7 illustrated a preferred form of the construction of the stairwell 42 and the adjacent deck 24. Each of the stairs 44 is supported on brackets 70 secured by screws (not shown). The brackets 70 and stairs are preferably finished hardwood construction, such as oak. The upper stair 44(*a*) is preferably vertically aligned with upper deck 24 and is supported on the vertical wall 12(*a*).

As will be appreciated from the above description, the multiple station carrel unit is simple in construction, inexpensive to manufacture and can easily be shipped in an unassembled flat condition in a very small carton. The assembly of the entire structure can be done by a novice without a special major construction skills and the final finished unit will be of sturdy construction and will have the weight distributed symmetrical because of the alternating configuration of the stacked work stations.

Figure 9:
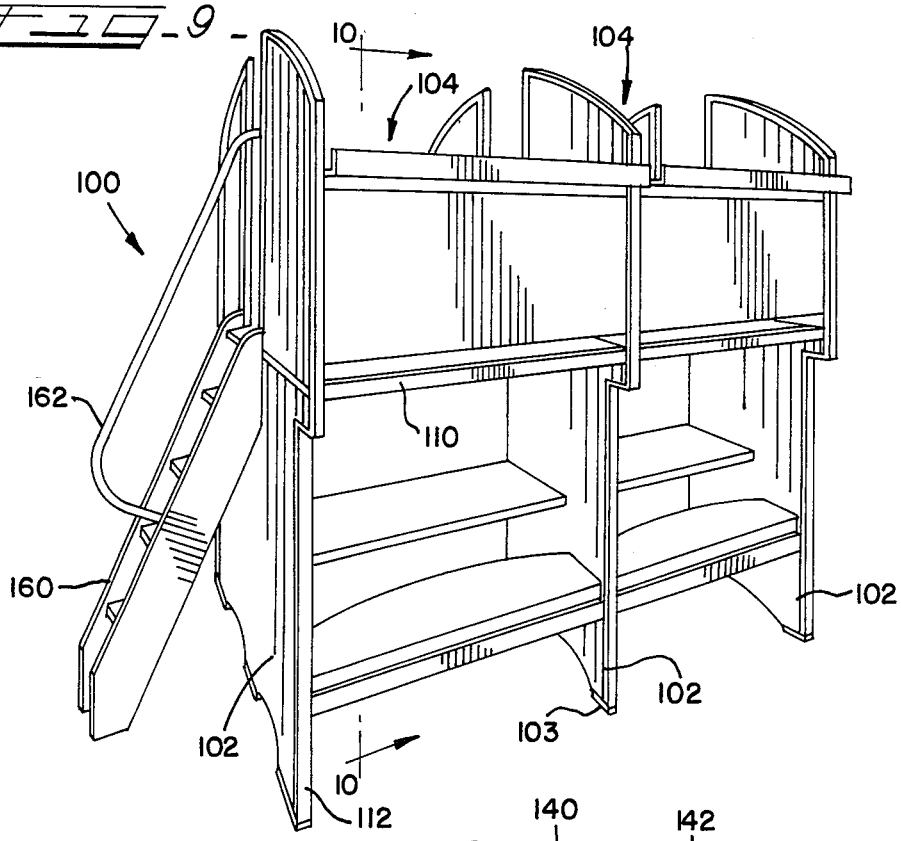
FIG. 9 is a perspective view of a modified form of carrel unit.
Figure 10:
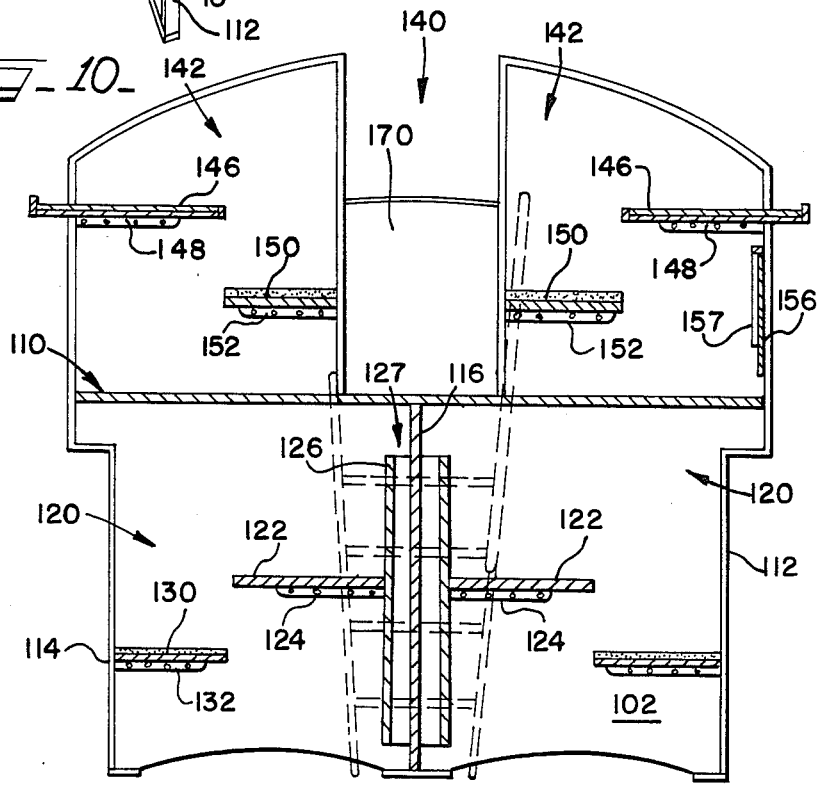
FIG. 10 is a cross-sectional view as viewed along line 10—10 of FIG. 9.

A slightly modified construction is illustrated in FIG. 9 and shows a carrel unit that is designed to provide eight individual work stations in a single self-supporting unit. As illustrated therein, the unit 100 includes three equally spaced side walls 102 that are substantially coextensive and are supported on lower edges 103. In this embodiment, three substantially identical side walls 102 are illustrated and two adjacent side walls 102 extend parallel to each other in the vertical direction and define a compartment 104 that is divided into a plurality of individual work stations. Thus, a deck or floor 110 extends between a front edge 112 and a rear edge 114 of the side walls and defines a floor for an upper compartment section and a ceiling for a lower compartment section. The floor or deck may be supported in the manner described in connection with previous embodiment and is further supported by a common wall 116 that divides the lower section of the compartment into two individual lower work stations 120. Each of the lower work stations 120 has a work-supporting surface 122 extending from the common wall 116 and is supported on the side walls 102 by suitable brackets 124. If desired, a sound proofing panel 126 may be located along the common wall 116 to minimize any sound emission through the common wall. This may also provide an air circulation gap 127 behind the surface 122.

Again, each lower work station 120 has a seat 130 in the form of a bench seat which is supported by brackets 132 on the respective side walls 102 and is located to be generally offset from the work-supporting surface so that the occupant can easily gain access and manipulate the legs into the space between the work-supporting surface and the adjacent edge of the bench.

The upper section of each compartment also has a walkway 140 along the center which is located above the common wall 116 and defines front and rear upper work stations 142, that are substantially identical construction. Upper front work station 142, has a work-supporting surface 146 extending between side walls 102 and supported by brackets 148. Since the area between the side walls 102 is open, the work-supporting surface may extend beyond the front edges 114, as shown. The work station 142 also has a seat means 150 supported on side walls 102 adjacent the walkway by brackets 152 for access thereto.

Upper rear work station likewise has a work-supporting surface 146 and a seat means 150 positioned as a mirror image of the front work station 142. The space between the work surfaces 146 and the deck 110 is preferably enclosed with privacy panels 156 supported by brackets 157.

A stairway or ladder 160 is located at one end of the walkway 140 and may have a railing 162 associated therewith. The opposite end of the walkway 140 may be covered by a panel 170.

This application contains subject matter that is disclosed in co-pending application Ser. No. 941,939, filed Dec. 15, 1986, and incorporated herein by reference.

I claim:

1. A self-supporting multiple-station carrel unit comprising a plurality of substantially coextensive spaced side walls and having upper and lower edges with said lower edges defining a generally coplanar lower support surface, each side wall having substantially vertical front and rear edges and a top edge interconnecting said front and rear edges, generally horizontal deck means spaced from said upper and lower edges positioned between an adjacent pair of side walls and defining a lower work station and an upper work station, said deck means including a substantially continuous panel extending between said front and rear edges and defining a floor for said upper station and a ceiling for said lower station, a first working surface in said lower work station between and secured to said adjacent pair of side walls and extending generally parallel and below said deck means with a rear edge thereof generally aligned with said rear edges of said adjacent pair of side walls and a front edge spaced from said front edges of said side walls and a seating area between said working surface and said front edges of said side walls, said seating area being totally within the confines of said side walls with first seat means in said seating area, and a second working surface spaced above said deck means and below said upper edge, said second working surface extending between and secured to said adjacent pair of side walls and having a front edge generally aligned with said front edges of said side walls and a rear edge spaced from said rear edges of said side walls, a second seating area on said deck means and located above said first working surface with second seat means above said deck means in said second seating area, and ladder means extending from said lower edges to said deck means.

2. A self-supporting multiple station carrel unit as defined in claim 1, in which there are three transversely-spaced parallel side walls defining two adjacent compartments with said deck means located between respective adjacent side walls to divide each compartment into upper and lower sections, each lower section having a common dividing wall forming front and rear lower work stations each having a working surface and a seat means defined therein, said upper sections having a common walkway above said common dividing wall defining front and rear upper work stations in each compartment, each upper work station having a working surface and a seat means therein, and in which said ladder means includes a stairway at one end of said walkway.

3. A multi-tiered carrel unit including a plurality of at least four spaced side walls having substantially coextensive front, rear, top and bottom edges and being transversely spaced to define a plurality of compartments, deck means in each compartment spaced from said top and bottom edges and extending between said front and rear edges to divide each compartment into at least upper and lower work stations, a first work-supporting surface located in each said lower station spaced from said front edges and supported on said side walls adjacent said rear edges, a second work-supporting surface in each said upper work station spaced from said rear edges and supported on said side walls adjacent said front edges and offset from said first work-supporting surface in the front-to-rear direction, first seat means in each said lower station positioned between said front edges and said first work-supporting surface, second seat means in each said upper station between said rear edges and said second work-supporting surface, said first and second seat means each being connected to at least one side wall, and ladder means supported on an intermediate pair of said side walls between two compartment to gain access to said upper work stations from a supporting floor.

4. A carrel unit as defined in claim 3, further including panel means extending across said rear edges enclosing said compartments.

5. A carrel unit as defined in claim 3, in which said intermediate side walls have access openings leading from said ladder means to said upper work stations.

6. A carrel unit as defined in claim 3, in which said forward edges have extensions for said upper work stations with privacy panels extending between said extensions and located between said deck means and said second work-supporting surfaces.

7. A self-supporting multiple-station carrel unit comprising at least three substantially coextensive transversely-spaced side walls defining a plurality of compartments between respective adjacent pairs of side walls with each compartment having an intermediate deck means producing upper and lower sections, each lower section having a vertical divider wall forming front and rear lower work stations, each having a working surface and seat means therein, each upper section having a walkway defined by said deck means and located above the divider wall to divide said upper section into upper front and rear work stations, each having a working surface and seat means therein, said side walls having openings above said deck means so that said walkway extends between opposite ends of said carrel unit and ladder means leading from a supporting surface to said walkway.

* * * * *